US007746315B2

(12) United States Patent
Li et al.

(10) Patent No.: US 7,746,315 B2
(45) Date of Patent: Jun. 29, 2010

(54) TIMING CONTROL CIRCUIT AND LIQUID CRYSTAL DISPLAY USING SAME

(75) Inventors: Kuo-Feng Li, Miao-Li (TW); Sz-Hsiao Chen, Miao-Li (TW)

(73) Assignee: Innolux Display Corp., Miao-Li County (TW)

( * ) Notice: Subject to any disclaimer, the term of this patent is extended or adjusted under 35 U.S.C. 154(b) by 586 days.

(21) Appl. No.: 11/644,069

(22) Filed: Dec. 22, 2006

(65) Prior Publication Data

US 2007/0146292 A1 Jun. 28, 2007

(30) Foreign Application Priority Data

Dec. 23, 2005 (TW) ..... 94146289 A

(51) Int. Cl.
*G09G 3/36* (2006.01)

(52) U.S. Cl. ..... 345/100; 345/99

(58) Field of Classification Search ..... 345/87–100, 345/204

See application file for complete search history.

(56) References Cited

U.S. PATENT DOCUMENTS 6,473,077 B1 10/2002 Takenaka et al.
7,403,184 B1 7/2008 Moon
7,542,022 B2 * 6/2009 Park ..... 345/98
7,557,790 B2 * 7/2009 Jeon et al. ..... 345/98
2003/0043100 A1 * 3/2003 Moon ..... 345/87
2004/0178976 A1 * 9/2004 Jeon et al. ..... 345/87
2005/0052395 A1 * 3/2005 Choi et al. ..... 345/98
2005/0083102 A1 * 4/2005 Yonezawa ..... 327/333
2005/0219189 A1 * 10/2005 Fukuo ..... 345/96
2005/0253824 A1 * 11/2005 Lin ..... 345/204
2006/0071897 A1 * 4/2006 Moon ..... 345/98
2006/0164404 A1 * 7/2006 Maone et al. ..... 345/204
2006/0244705 A1 11/2006 Song et al.
2006/0279509 A1 * 12/2006 Milanesi ..... 345/100
2007/0279362 A1 * 12/2007 Wang ..... 345/99
2007/0285409 A1 * 12/2007 Fukuo ..... 345/204
2008/0238952 A1 * 10/2008 Kanou ..... 345/690

FOREIGN PATENT DOCUMENTS

CN 1650226 A 8/2005
TW 410322 B 11/2000

* cited by examiner

*Primary Examiner*—Nitin Patel
(74) *Attorney, Agent, or Firm*—Wei Te Chung

(57) ABSTRACT

An exemplary liquid crystal display (LCD) (20) includes an LCD panel (24), a timing control circuit (21), a plurality of gate drivers (23) connected to the LCD panel, and a plurality of data drivers (22) connected to the LCD panel. The timing control circuit includes a plurality of reduced swing differential signaling (RSDS) output terminals. Each data driver is electrically connected to a respective RSDS output terminal of the timing control circuit via an independent conducting line.

10 Claims, 2 Drawing Sheets

TIMING CONTROL CIRCUIT AND LIQUID CRYSTAL DISPLAY USING SAME

FIELD OF THE INVENTION

The present invention relates a timing control circuit and a liquid crystal display (LCD) using the timing control circuit.

GENERAL BACKGROUND

An LCD has the advantages of portability, low power consumption, and low radiation, and has been widely used in various portable information products such as notebooks, personal digital assistants (PDAs), video cameras and the like. Furthermore, the LCD is considered by many to have the potential to completely replace cathode ray tube (CRT) monitors and televisions.

A typical LCD usually includes an LCD panel, a gate driver for scanning the LCD panel, a timing control circuit for transmitting image data to the data driver, and a data driver for providing gradation voltages to the LCD panel according to the received image data. The LCD panel includes a color filter substrate, a thin film transistor (TFT) array substrate, and a liquid crystal layer sandwiched between the two substrates. When the LCD works, an electric field is applied to the liquid crystal molecules of the liquid crystal layer. At least some of the liquid crystal molecules change their orientations, whereby the liquid crystal layer provides anisotropic transmittance of light therethrough. Thus the amount of the light penetrating the color filter substrate is adjusted by controlling the strength of the electric field. In this way, desired pixel colors are obtained at the color filter substrate, and the arrayed combination of the pixel colors provides an image viewed on a display screen of the LCD.

If motion picture display is conducted on the LCD, problems of poor image quality may occur. For example, the residual image phenomenon may occur because a response speed of the liquid crystal molecules is too slow. In particular, when a gradation variation occurs, the liquid crystal molecules are unable to track the gradation variation within a single frame period and produce a cumulative response during several frame periods. Consequently, considerable research is being conducted with a view to developing various high-speed response liquid crystal materials as a way of overcoming this problem.

Further, the aforementioned problems such as the residual image phenomenon are not caused solely by the response speed of the liquid crystal molecules. For example, when the displayed image is changed in each frame period to display the motion picture, the displayed image of one frame period remains in a viewer's eyes as an afterimage, and this afterimage overlaps with the viewer's perception of the displayed image of the next frame period. This means that from the viewpoint of a user, the image quality of the displayed image is impaired.

In order to overcome this problem, a residual image reducing mode driving method for the LCD has been developed. The residual image reducing driving method includes the following steps: dividing a frame into a first sub-frame and a second sub-frame; a data driver providing gradation voltages corresponding to normal image data to an LCD panel in the first sub-frame; and after about a half of the frame has elapsed, the data driver providing black-inserting voltages corresponding to black image data to the LCD panel in the second sub-frame.

Accordingly, a viewer perceives the black image during the second sub-frame, and an afterimage of the normal image displayed in the first sub-frame is lost from the viewer's perception during the second sub-frame. This means that there is no overlap of an afterimage with a perceived image of the next frame. Thus from the viewpoint of a user, the image quality of the displayed image is clear.

However, when the LCD works in the residual image reducing mode, the timing controlling circuit needs to work at double a normal frequency so as to transmit both the normal image data and the additional black image data to the data driver.

FIG. 3 shows a typical timing control circuit used in an LCD that works in a normal driving mode. The timing control circuit 11 includes two low voltage differential signaling (LVDS) input terminals communicating with an external circuit of the LCD for receiving image data, and two reduced swing differential signaling (RSDS) output terminals for transmitting the image data to a data driver of the LCD.

When the LCD works in the normal driving mode, if a data-transmitting rate of the timing control circuit 11 is equal to "D" pixel/sec, a working frequency "$X_{normal}$" of the two RSDS output terminals of the timing control circuit 11 is calculated according to the following first formula (1):

$$X_{(normal)} = \frac{D}{\text{Port_number}} = \frac{D}{2} < S \tag{1}$$

The "Port_number" represents the number of RSDS output terminals of the timing control circuit 11. "S" represents an endurable frequency (maximum normal working frequency) of the data driver that communicates with the timing control circuit 11.

FIG. 4 shows the timing control circuit 11 used in an LCD that works in the residual image reducing mode. When the LCD works in the residual image reducing mode, the LVDS input terminals of the timing control circuit 11 need to receive additional black image data. If the amount of additional black image data is equal to the amount of normal image data, and the amount of the normal image data and additional black image data that the timing control circuit 11 needs transmit in one second is equal to "2D", the working frequency of the two RSDS output terminals of the timing control circuit 11 is calculated according to the following second formula (2):

$$X_{(black-inserting)} = \frac{2D}{\text{Port_number}} = \frac{2D}{2} \geqq S \tag{2}$$

As shown in formula (2), when the LCD works in the residual image reducing mode, the working frequency "$X_{black\text{-}inserting}$" of the timing control circuit 11 goes beyond the endurable frequency of the data driver. However, the data driver does not operate properly in a double frequency working condition. Therefore, the LCD needs one or more additional data drivers to deal with the additional black image data. Thus the cost of the LCD is increased.

What is needed, therefore, is an LCD that can overcome the above-described deficiencies.

SUMMARY

In one preferred embodiment, an LCD includes an LCD panel, a timing control circuit, a plurality of gate drivers connected to the LCD panel, and a plurality of data drivers connected to the LCD panel. The timing control circuit includes a plurality of reduced swing differential signaling (RSDS) output terminals. Each data driver is electrically connected to a respective RSDS output terminal of the timing control circuit via an independent conducting line.

Other advantages and novel features will become more apparent from the following detailed description when taken in conjunction with the accompanying drawings.

DETAILED DESCRIPTION OF PREFERRED EMBODIMENTS

Figure 1:
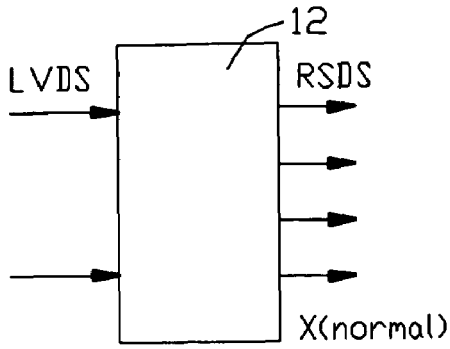
FIG. 1 is a diagram of a timing control circuit that is used in an LCD, according to an exemplary embodiment of the present invention.

FIG. 1 is a diagram of a timing control circuit that is used in an LCD, according to an exemplary embodiment of the present invention. The timing control circuit 12 includes two LVDS input terminals communicating with an external circuit of the LCD for receiving normal image data and black image data, and four RSDS output terminals for transmitting the normal image data and the black image data to data drivers of the LCD.

When the LCD having the timing control circuit 12 works in a residual image reducing mode, the LVDS input terminals of the timing control circuit 12 need to receive normal image data and black image data. If the amount of additional black image data is equal to the amount of normal image data, and both of these amounts are equal to "D", a working frequency $X_{black\text{-}inserting}$ of the four RSDS output terminals of the timing control circuit 12 is calculated according to the following third formula (3):

$$X_{(black-inserting)} = \frac{2D}{\text{Port_number}} = \frac{2D}{4} < S \tag{3}$$

The "Port_number" represents the number of RSDS output terminals of the timing control circuit 12. "S" represents an endurable frequency (maximum normal working frequency) of any one of the data drivers that communicates with the timing control circuit 11. That is, when the timing control circuit 12 is used in an LCD that works in the residual image reducing mode, the working frequency of the RSDS output terminals can remain in the range from 0-S. Thus the number of data drivers that communicate with the timing control circuit 12 and that provide the gradation voltages and black-inserting voltages to the LCD panel need not be increased.

Figure 2:
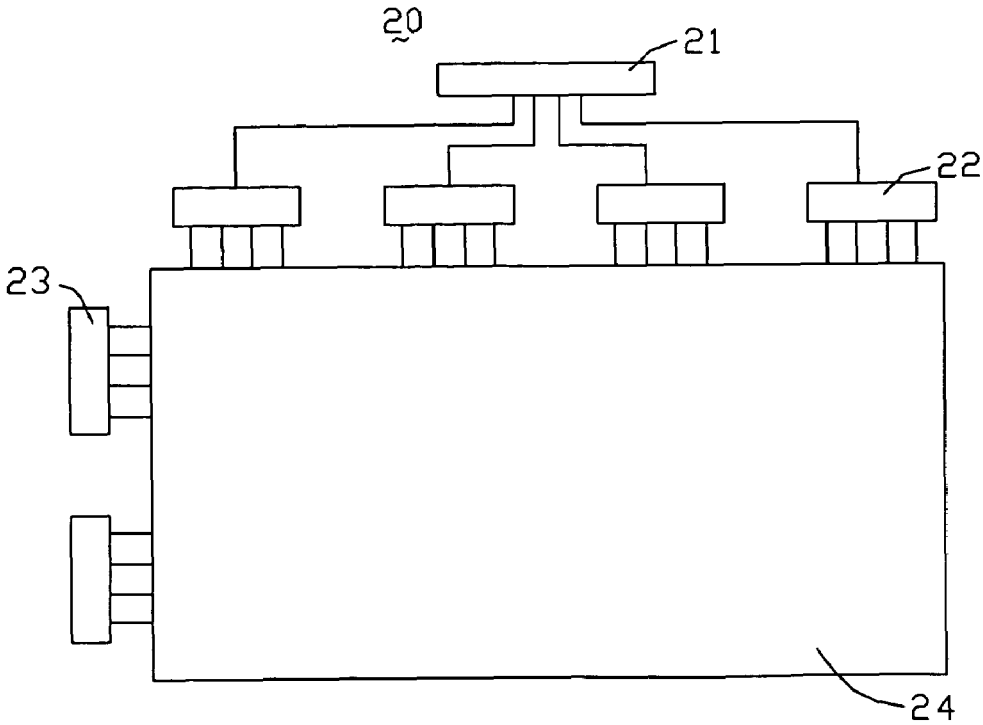
FIG. 2 is a block diagram of an LCD according to another exemplary embodiment of the present invention, the LCD including a timing control circuit equivalent to the timing control circuit of FIG. 1.
Figure 3:
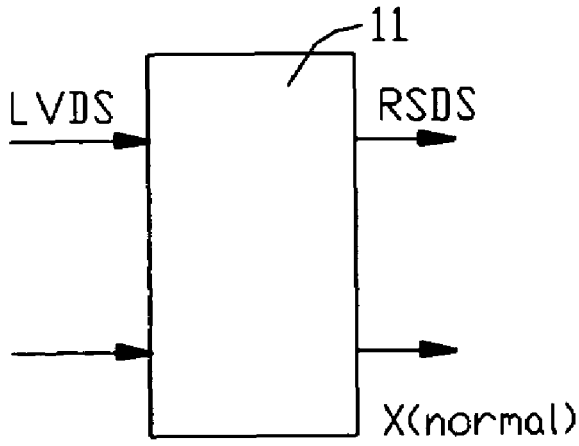
FIG. 3 (RELATED ART)
FIG. 3 is a diagram of a conventional timing control circuit used in an LCD that works in a normal driving mode.
Figure 4:
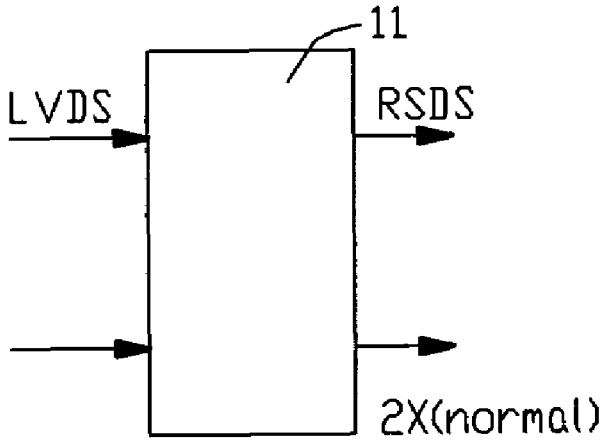
FIG. 4 (RELATED ART)
FIG. 4 is a diagram of the timing control circuit of FIG. 3 used in an LCD that works in a residual image reducing mode.

FIG. 2 is a block diagram of an LCD according to another exemplary embodiment of the present invention, the LCD including a timing control circuit equivalent to the above-described timing control circuit 12. The LCD 20 includes an LCD panel 24, two gate drivers 23 connected to the LCD panel 24, four data drivers 22 connected to the LCD panel 24, and a timing control circuit 21. The timing control circuit 21 includes two LVDS input terminals communicating with an external circuit of the LCD 20 for receiving normal image data and black image data, and four RSDS output terminals for transmitting the normal image data and the black image data to the four data drivers 22. The four RSDS output terminals are connected to the four data drivers 22, respectively. The gate drivers 23 are positioned adjacent a first side of the LCD panel 24, and the data drivers 22 are positioned adjacent a second side of the LCD panel 24. The first and second sides are adjacent sides of the LCD panel 24. The gate drivers 23 are configured for scanning the LCD panel 24. The data drivers 22 are configured for providing gradation voltages corresponding to the received image data to the LCD panel 24 when the LCD panel 24 is scanned. The data drivers 22 are also configured for providing black-inserting voltages corresponding to the received black image data to the LCD panel 24 when the LCD panel 24 is scanned.

Because the LCD 20 includes the timing control circuit 21 having the four RSDS output terminals, the working frequency of the RSDS output terminals can be controlled to be less than that of the data drivers 22. Therefore the number of data drivers 22 that communicate with the timing control circuit 21 and that provide the gradation voltages and black-inserting voltages to the LCD panel 24 need not be increased. Thus the LCD is cost-effective.

In an alternative embodiment of the present invention, another timing control circuit used in an LCD that has a plurality of data drivers 22 is provided. The time control circuit includes a number p (where p is a natural number) of RSDS output terminals, each of which is electrically connected to a respective data driver 22 via an independent conducting line.

If the amount of additional black image data is equal to "M", and the amount of normal image data is equal to "N", a working frequency $X_{black\text{-}inserting}$ of the plurality of RSDS output terminals of the timing control circuit is calculated according to the following fourth formula (4):

$$X_{(black-inserting)} = \frac{M+N}{\text{Port_number}} = \frac{M+N}{p} \leqq S \tag{4}$$

The "Port_number" represents the number of RSDS output terminals of the timing control circuit. "S" represents an endurable frequency of the data drivers 22 that communicate with the timing control circuit. The working frequency of the RSDS output terminals can be controlled to be less than that of the data drivers 22.

It is to be understood, however, that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A liquid crystal display (LCD) comprising:

an LCD panel;

a timing control circuit comprising a plurality of reduced swing differential signaling (RSDS) output terminals;

a plurality of data drivers connected to the LCD panel, each data driver being electrically connected to a respective RSDS output terminal of the timing control circuit via an independent conducting line; and a plurality of gate drivers connected to the LCD panel.

2. The LCD as claimed in claim 1, wherein the timing control circuit further comprises two low voltage differential signaling (LVDS) input terminals configured to communicate with an external circuit of the LCD and receive normal image data and black image data from the external circuit.

3. The LCD as claimed in claim 2, wherein the timing control circuit provides the normal image data and black image data to the data drivers via the RSDS output terminals.

4. The LCD as claimed in claim 1, wherein the gate drivers are configured for scanning the LCD panel, the data drivers are configured for providing gradation voltages according to the normal image data and providing black-inserting voltages according to the black image data to the LCD panel when the LCD panel is scanned.

5. The LCD as claimed in claim 1, wherein the gate drivers are positioned adjacent a first side of the LCD panel, the data drivers are positioned adjacent a second side of the LCD panel, and the first and second sides are two adjacent sides of the LCD panel.

6. The timing control circuit as claimed in claim 1, wherein there are four RSDS output terminals.

7. A timing control circuit used in a liquid crystal display (LCD) that has a plurality of data drivers, the timing control circuit comprising a number P (where P is a natural number) of reduced swing differential signaling (RSDS) output terminals each of which is electrically connected to a respective data driver via an independent conducting line, wherein a working frequency $X_{black\text{-}inserting}$ of the RSDS output terminals of the timing control circuit complies with the following formula:

$$X_{(black-inserting)} = \frac{M+N}{\text{Port_number}} = \frac{M+N}{p} \leqq S$$

wherein "N" represents an amount of image data that the timing control circuit receives from an external circuit, "M" represents an amount of additional black image data that the timing control circuit receives from the external circuit, and "S" represents an endurable frequency of the data drivers of the LCD.

8. The timing control circuit as claimed in claim 7, further comprising two low voltage differential signaling (LVDS) input terminals configured to communicate with the external circuit for receiving image data and additional black image data.

9. The timing control circuit as claimed in claim 7, wherein the timing control circuit provides the image data and additional black image data to the data drivers via the RSDS output terminals.

10. The timing control circuit as claimed in claim 7, wherein P is equal to 4.

* * * * *